US011195464B2

(12) United States Patent
Kawashima et al.

(10) Patent No.: US 11,195,464 B2
(45) Date of Patent: Dec. 7, 2021

(54) DISPLAY DEVICE AND DRIVING METHOD THEREOF

(71) Applicant: Wuhan China Star Optoelectronics Semiconductor Display Technology Co., Ltd., Hubei (CN)

(72) Inventors: Shingo Kawashima, Hubei (CN); Jun Li, Hubei (CN)

(73) Assignee: Wuhan China Star Optoelectronics Semiconductor Display Technology Co., Ltd., Hubei (CN)

( * ) Notice: Subject to any disclaimer, the term of this patent is extended or adjusted under 35 U.S.C. 154(b) by 321 days.

(21) Appl. No.: 16/500,693

(22) PCT Filed: Jan. 11, 2019

(86) PCT No.: PCT/CN2019/071290
§ 371 (c)(1),
(2) Date: Oct. 3, 2019

(87) PCT Pub. No.: WO2020/118833
PCT Pub. Date: Jun. 18, 2020

(65) Prior Publication Data

US 2021/0335254 A1 Oct. 28, 2021

(30) Foreign Application Priority Data

Dec. 13, 2018 (CN) ..... 201811522131.0

(51) Int. Cl.
*G09G 3/3258* (2016.01)

(52) U.S. Cl.
CPC ... *G09G 3/3258* (2013.01); *G09G 2310/0291* (2013.01); *G09G 2320/0233* (2013.01); *G09G 2330/021* (2013.01)

(58) Field of Classification Search
CPC combination set(s) only.
See application file for complete search history.

(56) References Cited

U.S. PATENT DOCUMENTS

2007/0194962 A1* 8/2007 Asayama ..... H03M 1/66 341/144
2013/0241562 A1* 9/2013 Jin ..... G09G 3/3233 324/414
2021/0174742 A1* 6/2021 Hwang ..... G09G 3/3258

* cited by examiner

*Primary Examiner* — Van N Chow
(74) *Attorney, Agent, or Firm* — Taft Stettinius & Hollister LLP

(57) ABSTRACT

A display device and a driving method are disclosed. The display device includes a plurality of pixel areas disposed in a display panel. Each pixel area includes at least one row of pixel units. The display panel further includes a plurality of collecting modules, a comparing module, and a processing module. Each collecting module is connected to the pixel units in each pixel area and configured to obtain and transmit input power voltage signals of the pixel units in a corresponding pixel area to the comparing module. The comparing module receives and compares the input power voltage signals with a base voltage respectively and transmits comparison results to the processing module respectively. The processing module adjusts data voltages of the pixel units in the corresponding pixel area respectively based on the comparison results in order to compensate the pixel units in the corresponding pixel area for resistive voltage drop differences.

10 Claims, 5 Drawing Sheets

DISPLAY DEVICE AND DRIVING METHOD THEREOF

CROSS-REFERENCE TO RELATED APPLICATIONS

This application is a U.S. National Phase of International PCT Application No. PCT/CN2019/071290 filed Jan. 11, 2019, which claims the benefit of Chinese Patent Application Serial No. 201811522131.0 filed Dec. 13, 2018, the contents of each application are incorporated herein by reference in their entirety.

BACKGROUND OF DISCLOSURE

1. Field of Disclosure

The present disclosure relates to the field of liquid crystal display technology, and more particularly, to a display device and a driving method thereof.

2. Description of Related Art

Organic light emitting diode (OLED) display panels are regarded as the most promising display devices due to their advantages such as being self-luminous, having a low driving voltage, a high luminous efficiency, a short response time, high sharpness, a high contrast, a nearly 180-degree viewing angle, a wide using temperature range, being able to achieve flexible display and large-area full-color display, etc.

According to driving methods, OLEDs can be categorized into two major types, which are passive matrix (PM) OLEDs and active matrix (AM) OLEDs, i.e., a direct addressing type and a thin film transistor (TFT) matrix addressing type.

In an active matrix organic light emitting diode (AMOLED) display panel, a plurality of pixels are arranged in an array, and each of the pixels is driven by an OLED pixel driving circuit.

As shown in FIG. 1, a conventional AMOLED pixel driving circuit with a 2T1C structure includes a switch TFT T1, a driver TFT T2, and a storage capacitor Cst. The switch TFT and the driver TFT are both N-type thin film transistors. A driving current of an OLED is controlled by the driver TFT. It is known that the driving current can be calculated according to the formula: $I_{OLED}=k(V_{gs}-V_{th})^2$, where $I_{OLED}$ represents the driving current, k is a current amplifying coefficient determined by electricity characteristics of the driver TFT itself, Vgs is a voltage difference between a gate electrode and a source electrode of the driver TFT, and Vth is a threshold voltage of the driver TFT. It can be seen that the driving current $I_{OLED}$ correlates with the threshold voltage of the driver TFT.

As a drift of the threshold voltage Vth of the driver TFT results in a change in the driving current of the OLED, easily causing unevenness of brightness of AMOLED display panels. Thus, problems such as displaying badly, affecting picture quality, and so on appear.

Because the conventional AMOLED pixel driving circuit with the 2T1C structure fails to compensate for the threshold voltage of the driver TFT, related researchers propose a variety of pixel driving circuits which can compensate for the threshold voltage of the driver TFT. Please refer to FIG. 2, which is a conventional AMOLED pixel driving circuit with a 7T1C structure for compensating for the threshold voltage of the driver TFT. The circuit includes seven thin film transistors and a capacitor, that is, a first P-type thin film transistor T1 (i.e., the driver TFT), a second P-type thin film transistor T2, a third P-type thin film transistor T3, a fourth P-type thin film transistor T4, a fifth P-type thin film transistor T5, a sixth P-type thin film transistor T6, and a seventh P-type thin film transistor T7. In combination with a time sequence diagram shown in FIG. 3, the specific working process of the AMOLED pixel driving circuit with the 7T1C structure is described as follows:

In a first stage, i.e., a gate restoration stage of the driver TFT, a previous scan signal scan[n−1] is at a low voltage level, a scan signal scan[n] and a light-emitting control signal EM are at a high voltage level, and then potential of a gate electrode of the first P-type thin film transistor T1 is restored to a lower potential VI.

In a second stage, i.e., a stage in data signal writing and threshold voltage compensation while restoration of the OLED is completed, the scan signal scan[n] is at the low voltage level, the previous scan signal scan[n−1] and the light-emitting control signal EM are both at the high voltage level. At this moment, the gate electrode and a drain electrode of the first P-type thin film transistor T1 are connected to be a short circuit so that a diode connect structure is formed. A data signal Data is written to a source electrode of the first P-type thin film transistor through the third P-type thin film transistor T3 conducted, and the potential of the gate electrode of the first P-type thin film transistor T1 is charged to: Vdata−Vth, where Vdata represents a voltage of the data signal Data, Vth represents the threshold voltage of the driver TFT, through the diode connect structure. On the other hand, the seventh P-type thin film transistor T7 turns on, an anode of the OLED and the potential VI are connected to each other, and then the anode of the OLED is restored to the potential VI (i.e., a restoration voltage).

In a third stage, i.e., a light-emitting stage, only the light-emitting control signal EM is at the low voltage level, the scan signal scan[n] and the previous scan signal scan[n−1] are at the high voltage level, the fifth P-type thin film transistor T5 and the sixth P-type thin film transistor T6 turn on, and then the driving current which flows from the first P-type thin film transistor T1 to the OLED drives the OLED to illuminate. The driving current is calculated according to the formula:

$$I_{OLED}=k(VDD-(V\text{data}-|Vth|)-|Vth|)^2=k(VDD-V\text{data})^2,$$

where $I_{OLED}$ represents the driving current, k represents the current amplifying coefficient of the first P-type thin film transistor T1 (i.e., the driver TFT), and VDD represents a power positive-voltage. It can be seen that the driving current $I_{OLED}$ is irrelevant to the threshold voltage Vth of the first P-type thin film transistor T1, so that the problem of displaying pictures badly in AMOLED panels caused by the drift of the threshold voltage Vth of the first P-type thin film transistor T1 (i.e., the driver TFT) is eliminated. Also, the OLED can be restored so that contrast of AMOLED is improved.

SUMMARY

A technical problem is that, there exists a deficiency in the above active matrix organic light emitting diode (AMOLED) pixel driving circuit with a 7T1C structure. Because a driving current correlates with a power positive-voltage, the power positive-voltage VDD is required to supply currents when an organic light emitting diode illuminates. In view that there exist impedances in a power trace of voltage VDD, an actual voltage VDD gained by each pixel unit is less than the voltage VDD supplied from a power due to effects of resistive voltage drop (i.e., IR drop). That is, the actual voltage VDD is calculated according to the formula: $VDD_{pixel}=VDD-I_{oled}*R_{VDD}$. Compared with the bottom of an AMOLED panel, the top of the AMOLED panel is located further away from the power positive-voltage VDD and has greater resistance. Thus, the power positive-voltage VDD at the top of the AMOLED panel drops significantly, causing the top of the panel to darken and causing the bottom of the panel to lighten, so that uniformity of panel is seriously affected.

An important topic of display technology is that how to effectively solve the problem of darkening at the top of the panel and lightening at the bottom of the panel, and that the uniformity of panel is improved.

The object of the present disclosure is to provide a display device and a driving method thereof, which can effectively compensate for deteriorating uniformity of panel caused by the resistive voltage drop and improve uniformity of display panel.

According to one aspect of the present disclosure, the present disclosure provides a display device, including: a plurality of pixel areas disposed in a display panel, wherein the display panel is divided into the plurality of pixel areas along a first direction, and wherein the first direction extends from a side near a power end of the display panel to a side away from the power end; wherein each of the plurality of pixel areas includes at least one row of a plurality of pixel units; and wherein the display panel further includes a plurality of collecting modules, a comparing module, and a processing module, wherein each of the plurality of collecting modules is connected to the plurality of pixel units in the each of the plurality of pixel areas and configured to obtain and transmit input power voltage signals of the plurality of pixel units in a corresponding pixel area to the comparing module, wherein the comparing module receives and compares the input power voltage signals with a base voltage respectively and transmits comparison results to the processing module respectively, and wherein the processing module adjusts data voltages of the plurality of pixel units in the corresponding pixel area respectively based on the comparison results in order to compensate the plurality of pixel units in the corresponding pixel area for resistive voltage drop differences.

In an embodiment of the present disclosure, the base voltage is a voltage of the power end of the display panel.

In an embodiment of the present disclosure, the each of the plurality of pixel areas is connected to a power trace configured to provide a voltage of the power end disposed at the bottom of the display panel.

In an embodiment of the present disclosure, the power trace extends in the display panel along the first direction.

In an embodiment of the present disclosure, the each of the plurality of pixel areas includes three rows of pixel units.

In an embodiment of the present disclosure, an area occupied by the each of the plurality of pixel areas in the display panel is identical.

In an embodiment of the present disclosure, the comparing module includes an operational amplifier.

In an embodiment of the present disclosure, the processing module includes a data driving chip, and the data driving chip responsively adjusts the data voltages of the plurality of pixel units in the corresponding pixel area based on the comparison results, generated from the comparing module, and transmits the adjusted data voltages to the plurality of pixel units in the corresponding pixel area through data lines.

According to another aspect of the present disclosure, the present disclosure provides a method of controlling the above display device. The method includes the following steps: first, obtaining the input power voltage signals of the plurality of pixel units in a pixel area; secondly, comparing the input power voltage signals with the base voltage and outputting the comparison results; thirdly, receiving the comparison results and responsively adjusting the data voltages of the plurality of pixel units in the corresponding pixel area based on the comparison results; and fourthly, transmitting the adjusted data voltages to the plurality of pixel units in the corresponding pixel area through data lines.

In an embodiment of the present disclosure, the method further includes, prior to the step of obtaining the input power voltage signals of the plurality of pixel units in the pixel area, the step of dividing the display panel into the plurality of pixel areas along the first direction, wherein the each of the plurality of pixel areas includes the at least one row of the plurality of pixel units, and wherein the first direction extends from the side near the power end of the display panel to the side away from the power end.

The advantage of the present disclosure is that, the display device and the driving method described in the present disclosure can effectively compensate for the deteriorating uniformity of panel caused by the resistive voltage drop and improve the uniformity of display panel.

BRIEF DESCRIPTION OF DRAWINGS

In order to more clearly illustrate technical solutions in the embodiments of the present disclosure, the drawings required for describing the embodiments will be briefly introduced below. It is obvious that the following drawings are merely some embodiments of the present disclosure, and a person having ordinary skill in this field can obtain other drawings according to these drawings under the premise of not paying creative works.

DETAILED DESCRIPTION OF EMBODIMENTS

Figure 1:
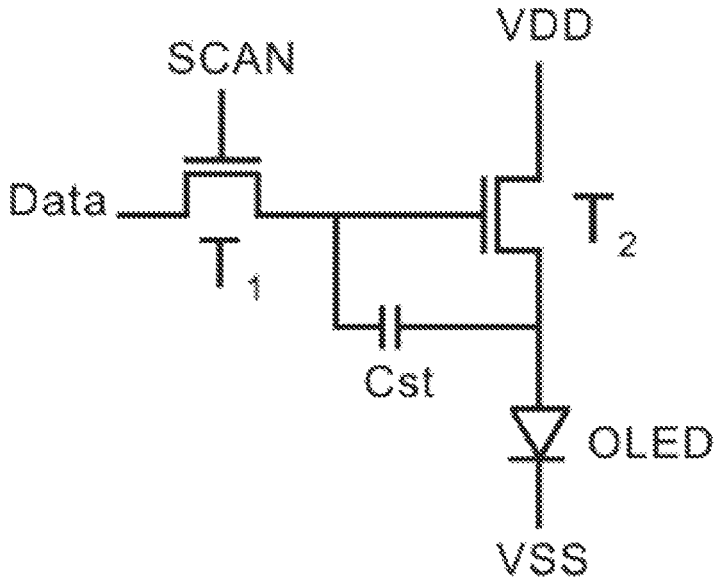
FIG. 1 is a schematic diagram of a conventional pixel driving circuit with a 2T1C structure.
Figure 2:
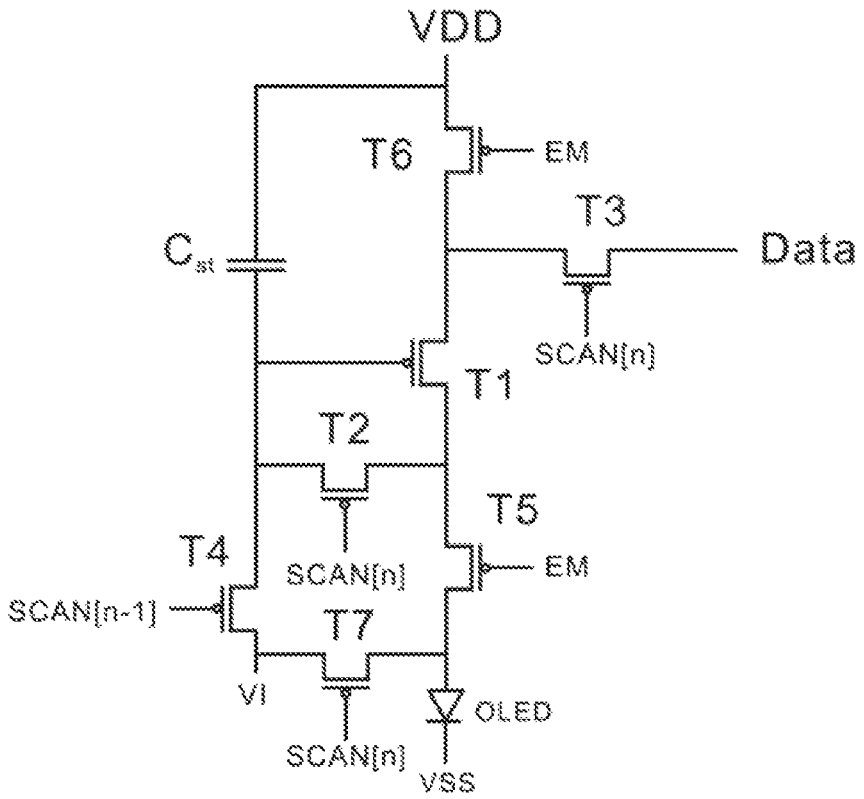
FIG. 2 is a schematic diagram of a conventional pixel driving circuit with a 7T1C structure.
Figure 3:
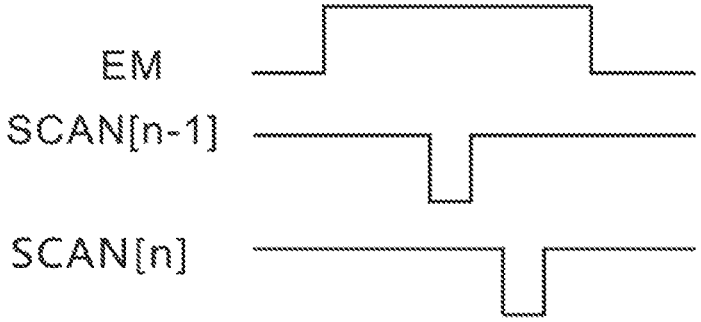
FIG. 3 is a time sequence diagram of a conventional pixel driving circuit with a 7T1C structure.

The technical solutions in the embodiments of the present disclosure will be described clearly and completely in conjunction with the accompanying drawings in the embodiments of the present disclosure. Apparently, the described embodiments are merely a part of the embodiments of the present disclosure instead of all of the embodiments. All of the other embodiments obtained by those skilled in the related art without creative efforts, based on the embodiments in the present disclosure, belong to the protection scope of the present disclosure.

Terms "first", "second", "third" and the like (if existing) in the specification, the claims, and the accompanying drawings are used to distinguish similar objects instead of describing a specific sequence or a precedence order. It should be understood that the described objects can be exchanged in any suitable situations. In addition, terms "include", "have" and any variations thereof intend to cover nonexclusive inclusions.

In this patent document, the accompanying drawings discussed below and the various embodiments used to describe the principles of the present disclosure are by way of illustration only and should not be construed to limit the scope of the present disclosure. Those skilled in the art will understand that the principles of the present disclosure can be implemented in any suitably arranged system. The exemplary embodiments will be described in detail and examples of these embodiments are illustrated in the accompanying drawings. In addition, a terminal according to exemplary embodiments will be described in detail with reference to the accompanying drawings. Like reference numerals in the accompanying drawings denote like elements.

The terms used in the present specification are merely used to describe particular embodiments, and are not intended to reveal the concepts of the present disclosure. An expression used in the singular form encompasses the expression in the plural form, unless it has a clearly different meaning in the context. In the present specification, it is to be understood that the terms such as "including," "having," and "comprising" are intended to indicate the existence of the features, numbers, steps, actions, or combinations thereof disclosed in the specification, and are not intended to preclude the possibility that one or more other features, numbers, steps, actions, or combinations thereof can exist or can be added. Like reference numerals in the accompanying drawings denote like parts.

A display device and a driving method thereof provided in the embodiments of the present disclosure will be respectively explained in detail below.

Figure 4:
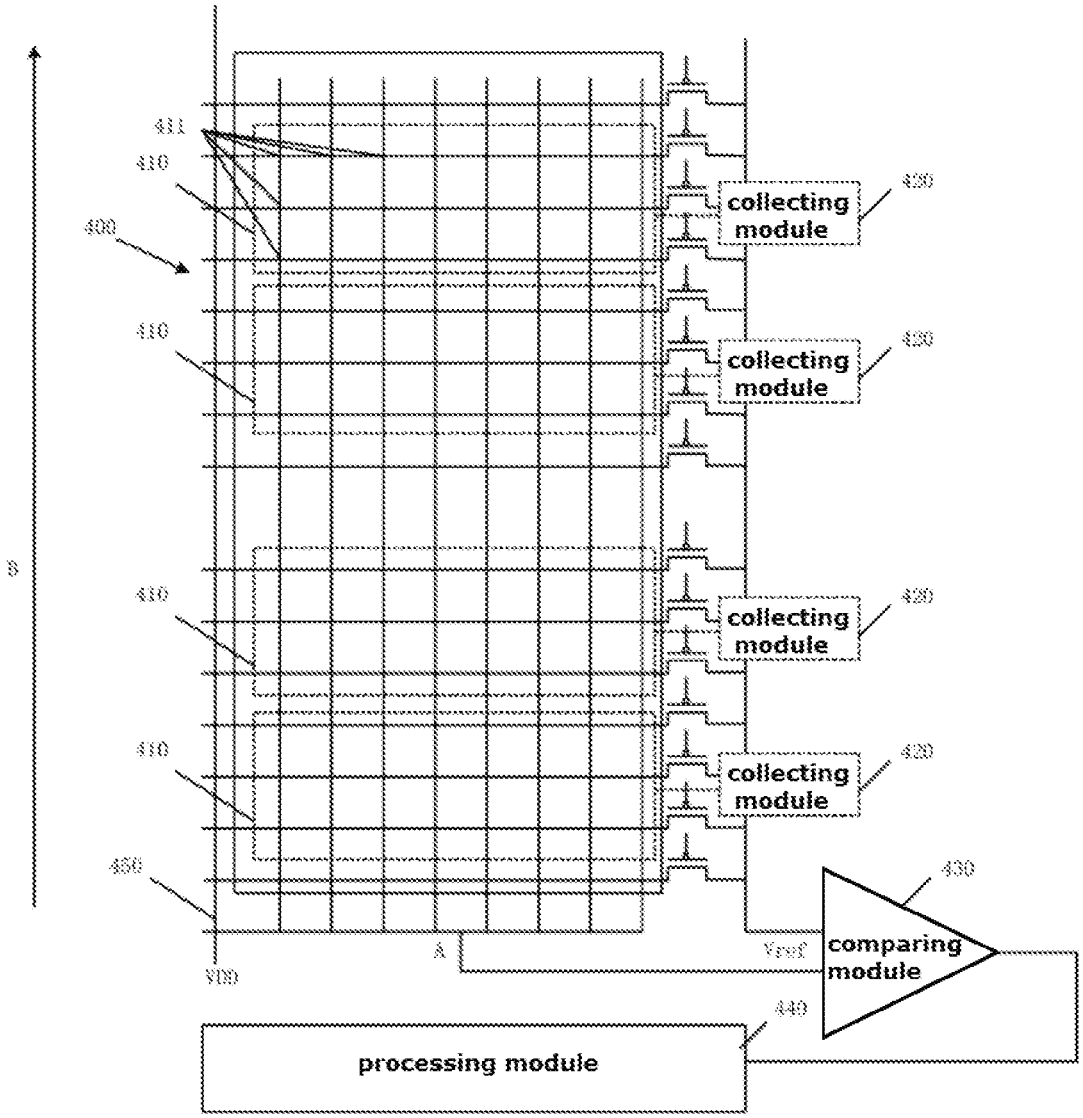
FIG. 4 is a schematic structural diagram of a display panel in a display device according to an embodiment of the present disclosure.
Figure 5:
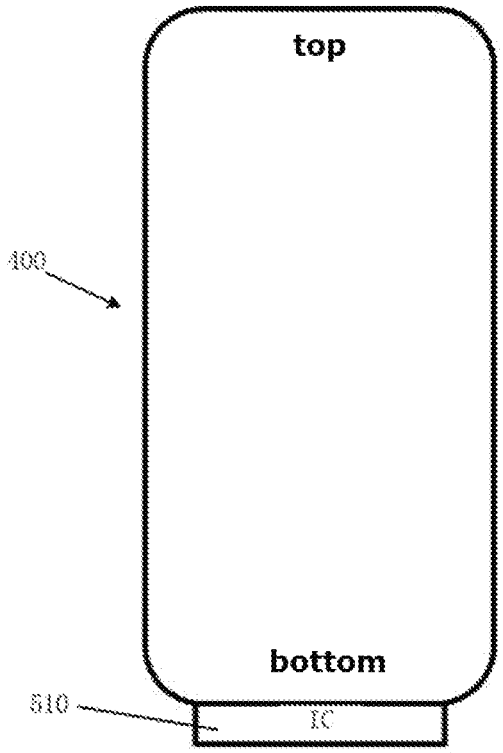
FIG. 5 is a schematic structural diagram of the display device according to the embodiment of the present disclosure.
Figure 6:
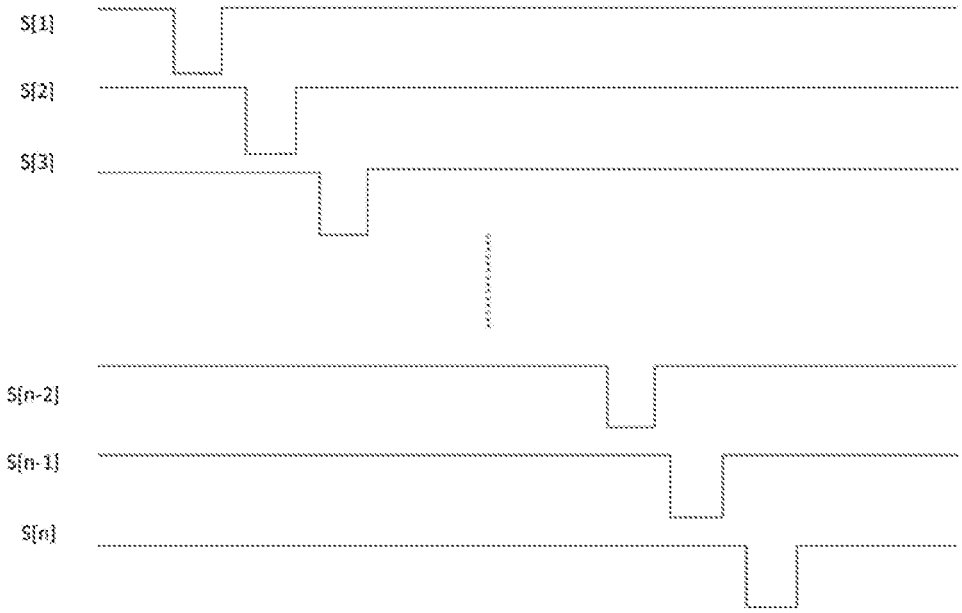
FIG. 6 is a controlled time sequence diagram of the display device executing a compensation operation according to the embodiment of the present disclosure.

Referring to FIGS. 4-6, wherein FIG. 4 is a schematic structural diagram of a display panel in a display device according to an embodiment of the present disclosure. FIG. 5 is a schematic structural diagram of the display device according to the embodiment of the present disclosure. FIG. 6 is a controlled time sequence diagram of the display device executing a compensation operation according to the embodiment of the present disclosure, wherein S[1], S[2], S[3], S[4] . . . , S[n−1], and S[n] represent scan signals in different rows.

The present disclosure provides a display device including a plurality of pixel areas 410 disposed in a display panel 400. The display panel 400 is divided into the plurality of pixel areas 410 along a first direction B. The first direction B extends from a side near a power end A of the display panel 400 to a side away from the power end. In the present embodiment, the power end A of the display panel 400 is disposed at the bottom of the display panel 400, and thus the first direction B extends from the bottom of the display panel 400 to the top of the display panel 400. The display panel 400 is evenly divided into the plurality of pixel areas 410 along the first direction B. An area occupied by each of the plurality of pixel areas 410 in the display panel 400 is identical.

Further, each of the plurality of pixel areas 410 includes at least one row of a plurality of pixel units 411. Preferably, in the present embodiment, each of the pixel areas 410 includes three rows of the plurality of pixel units 411.

In the present embodiment, each of the plurality of pixel areas 410 is connected to a power trace 450 configured to provide a voltage of the power end A disposed at the bottom of the display panel 400. Moreover, the power trace 450 extends in the display panel 400 along the first direction B.

In addition, in the present embodiment, each row of the plurality of pixel units 411 in the same pixel area 410 is identical, that is, the whole pixel units 411 in the same pixel are identical. each of the pixel units 411 includes a pixel driving circuit (not shown) with the same structure and a corresponding light-emitting component (not shown) such as an organic light emitting diode.

The display panel 400 further includes a plurality of collecting modules 420, a comparing module 430, and a processing module 440. Each of the collecting modules 420 is connected to the pixel units 411 in each of the pixel areas 410 and configured to obtain and transmit input power voltage signals of the pixel units 411 in a corresponding pixel area 410 to the comparing module 430. That is to say, each of the collecting modules 420 corresponds to each of the pixel areas 410 respectively.

The comparing module 430 receives and compares the input power voltage signals with a base voltage Vref respectively and transmits comparison results to the processing module 440 respectively. The base voltage Vref is a voltage of the power end A of the display panel 400.

In the present embodiment, the comparing module 430 includes an operational amplifier (not marked in the figures). Of course, in another embodiment, the comparing module 430 can also use another component, similar to the operational amplifier, such as a relevant comparator match circuit to achieve the same function.

The processing module 440 adjusts data voltages of the plurality of pixel units 411 in the corresponding pixel area 410 respectively based on the comparison results in order to compensate the pixel units 411 in the corresponding pixel area 410 for resistive voltage drop differences. Specifically, according to the comparison results such as a voltage difference between the collected input power voltage signals and the base voltage Vref and according to a compensation rule, the processing module 440 converts the voltage difference into a corresponding compensation value. The compensation rule is predetermined and relevant to the formula: $I_{OLED}=k(VDD-Vdata)^2$, where $I_{OLED}$ represents a driving current, k represents a current amplifying coefficient of a driver thin film transistor, VDD represents a power positive-voltage, and Vdata represents a data voltage.

In the present embodiment, the processing module 440 includes a data driving chip (not marked in the figures). The data driving chip can be disposed in a chip 510 located at the bottom of the display panel. The data driving chip responsively adjusts the data voltages of the pixel units 411 in the corresponding pixel area 410 based on the comparison results (such as the voltage difference), generated from the comparing module 430, and transmits the adjusted data voltages to the pixel units 411 in the corresponding pixel area 410 through data lines. That is to say, the data driving chip obtains the corresponding compensation value according to the voltage difference and the predetermined compensation rule and then modifies the data voltages transmitted to the pixel units 411 in the corresponding pixel area 410 in advance based on the compensation value in order to obtain a modified final data voltage. Next, the data driving chip transmits the final data voltage to the pixel units 411 in the corresponding pixel area 410 through the data lines.

Because there exist deficiencies regarding resistive voltage drop in conventional display devices, the top of the display panel 400 darkens and the bottom of the display panel 400 lightens. For this, the present disclosure compensates each of the pixel areas 410 for resistive voltage drop through collecting input power voltages in the pixel areas 410 located at the top of the display panel 400 and input power voltages in the pixel areas 410 located at the bottom of the display panel 400, comparing the input power voltages with the base voltage Vref respectively, and responsively adjusting the data voltages of the pixel units 411 in the corresponding pixel area 410 based on the comparison results, that is, modifying the data voltages, such as reducing the modification of the data voltages of the pixel areas 410 located at the top of the display panel 400, and enlarging the modification of the data voltages of the pixel areas 410 located at the bottom of the display panel 400.

It needs to be noted that input power voltages of the pixel units 411 in adjacent rows in the same pixel area 410 can be regarded as being identical basically because voltage drop between the input power voltages of the pixel units 411 in adjacent rows in the same pixel area 410 is small. Further, the same pixel area 410 can include, but not limited to, two rows of pixel units 411 or three rows of pixel units 411 or four rows of pixel units 411. Preferably, the same pixel area 410 includes three rows of pixel units 411. Thus, under the premise of without reducing the effects of compensating for resistive voltage drop, the above method can be implemented, that is, to simplify a number of pixel areas so that circuits can be simplified, and power consumption of relevant components is saved.

Of course, in another embodiment, the pixel area 410 can only include a row of pixel units 411, and each of the collecting modules 420 is connected to input power voltage of each row of pixel units 411. In this way, more collecting modules 420 are required; however, data voltages of the pixel units 411 in a corresponding row can be more accurately adjusted, and each row of pixel units 411 can be more accurately compensated for resistive voltage drop further.

The display device of the present disclosure can effectively compensate for deteriorating uniformity of panel caused by the resistive voltage drop and improve uniformity of display panel 400 through using the collecting modules 420, the comparing module 430, and the processing module 440.

Figure 7:
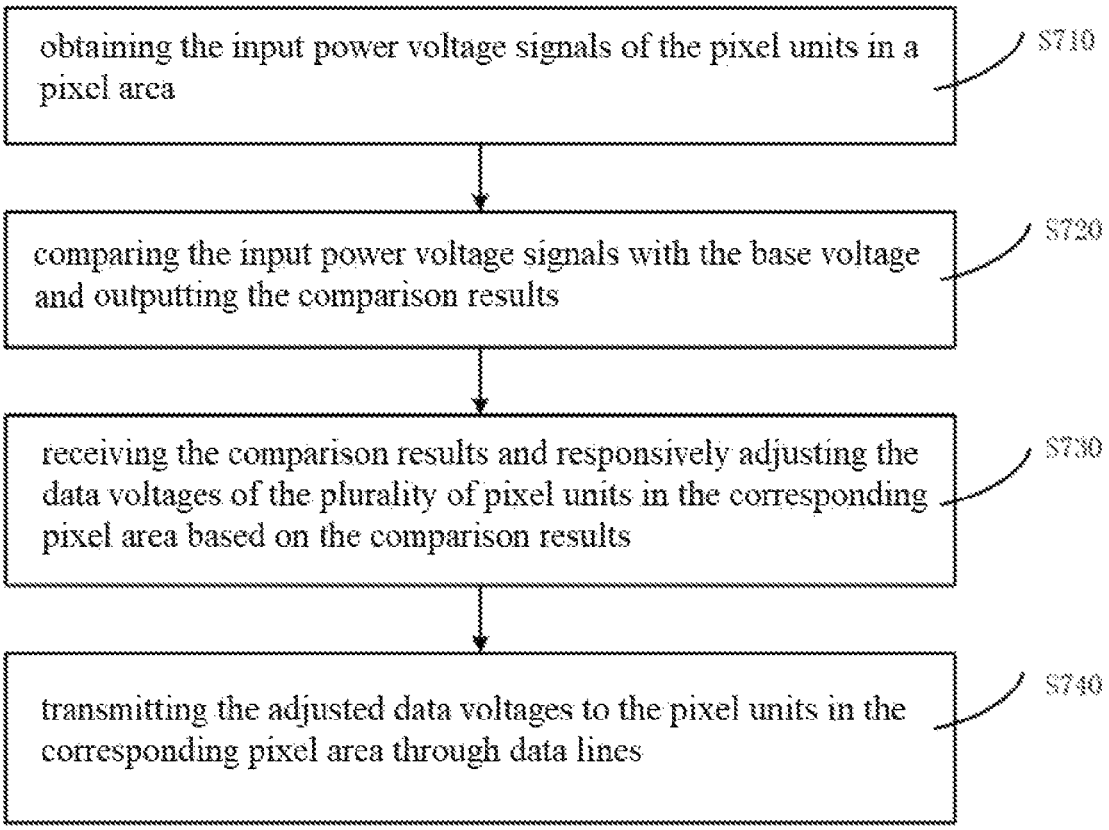
FIG. 7 is a stepwise flowchart of a method for controlling the display device according to an embodiment of the present disclosure.

Referring to FIG. 7, which is a stepwise flowchart of a method for controlling the display device according to an embodiment of the present disclosure.

The present disclosure provides a method of controlling the above display device. The specific structure of the display device is described above and is not repeated here.

The controlling method includes the following steps:

Step S710: obtaining the input power voltage signals of the pixel units in a pixel area.

In an embodiment, the method further includes, prior to the step of obtaining the input power voltage signals of the pixel units 411 in the pixel area 410, the step of: dividing the display panel 400 into the plurality of pixel areas 410 along the first direction B, wherein each of the pixel areas 410 includes the at least one row of the plurality of pixel units 411, and wherein the first direction B extends from the side near the power end A of the display panel 400 to the side away from the power end.

Step S720: comparing the input power voltage signals with the base voltage and outputting the comparison results.

The base voltage Vref is the voltage of the power end A of the display panel 400. In the present embodiment, the comparing module 430 includes the operational amplifier.

Step S730: receiving the comparison results and responsively adjusting the data voltages of the pixel units in the corresponding pixel area based on the comparison results.

The processing module 440 adjusts the data voltages of the pixel units 411 in the corresponding pixel area 410 respectively based on the comparison results in order to compensate the pixel units 411 in the corresponding pixel area 410 for resistive voltage drop differences. Specifically, according to the comparison results such as the voltage difference between the collected input power voltage signals and the base voltage Vref and according to the compensation rule, the processing module 440 converts the voltage difference into the corresponding compensation value. The compensation rule is predetermined and relevant to the formula: $I_{OLED}=k(VDD-Vdata)^2$, where $I_{OLED}$ represents the driving current, k represents the current amplifying coefficient of the driver thin film transistor, VDD represents the power positive-voltage, and Vdata represents the data voltage.

In the present embodiment, the processing module 440 includes the data driving chip. The data driving chip obtains the corresponding compensation value according to the voltage difference and the predetermined compensation rule and then modifies the data voltages transmitted to the pixel units 411 in the corresponding pixel area 410 in advance based on the compensation value in order to obtain the modified final data voltage.

Step S740: transmitting the adjusted data voltages to the pixel units in the corresponding pixel area through the data lines.

The data driving chip transmits the final data voltage to the pixel units 411 in the corresponding pixel area 410 through the data lines.

In the present disclosure, the display device and the driving method thereof can effectively compensate for deteriorating uniformity of panel caused by the resistive voltage drop and improve uniformity of display panel 400.

The foregoing discussions are merely some preferred embodiments of the present disclosure, it should be noted that, for an ordinary skill in the art, under the premise of without departing from the principle of the present disclosure, several improvements and modifications can be made, and these improvements and modifications should be included in the protection scope of the present disclosure.

The industrial applicability of the present disclosure is that, the topic of the application can be manufactured and used so that it has an industrial practicality.

What is claimed is:

1. A display device, comprising: a plurality of pixel areas disposed in a display panel, wherein the display panel is divided into the plurality of pixel areas along a first direction, and wherein the first direction extends from a side near a power end of the display panel to a side away from the power end;

wherein each of the plurality of pixel areas comprises at least one row of a plurality of pixel units; and wherein the display panel further comprises a plurality of collecting modules, a comparing module, and a processing module, wherein each of the plurality of collecting modules is connected to the plurality of pixel units in the each of the plurality of pixel areas and configured to obtain and transmit input power voltage signals of the plurality of pixel units in a corresponding pixel area to the comparing module, wherein the comparing module receives and compares the input power voltage signals with a base voltage respectively and transmits comparison results to the processing module respectively, and wherein the processing module adjusts data voltages of the plurality of pixel units in the corresponding pixel area respectively based on the comparison results in order to compensate the plurality of pixel units in the corresponding pixel area for resistive voltage drop differences.

2. The display device of claim 1, wherein the base voltage is a voltage of the power end of the display panel.

3. The display device of claim 1, wherein the each of the plurality of pixel areas is connected to a power trace configured to provide a voltage of the power end disposed at the bottom of the display panel.

4. The display device of claim 3, wherein the power trace extends in the display panel along the first direction.

5. The display device of claim 1, wherein the each of the plurality of pixel areas comprises three rows of pixel units.

6. The display device of claim 1, wherein an area occupied by the each of the plurality of pixel areas in the display panel is identical.

7. The display device of claim 1, wherein the comparing module comprises an operational amplifier.

8. The display device of claim 1, wherein the processing module comprises a data driving chip, and wherein the data driving chip responsively adjusts the data voltages of the plurality of pixel units in the corresponding pixel area based on the comparison results, generated from the comparing module, and transmits the adjusted data voltages to the plurality of pixel units in the corresponding pixel area through data lines.

9. A method of controlling the display device according to claim 1, comprising:

obtaining the input power voltage signals of the plurality of pixel units in a pixel area;

comparing the input power voltage signals with the base voltage and outputting the comparison results;

receiving the comparison results and responsively adjusting the data voltages of the plurality of pixel units in the corresponding pixel area based on the comparison results; and transmitting the adjusted data voltages to the plurality of pixel units in the corresponding pixel area through data lines.

10. The method of claim 9, further comprising, prior to the step of obtaining the input power voltage signals of the plurality of pixel units in the pixel area, the step of: dividing the display panel into the plurality of pixel areas along the first direction, wherein the each of the plurality of pixel areas comprises the at least one row of the plurality of pixel units, and wherein the first direction extends from the side near the power end of the display panel to the side away from the power end.

* * * * *